United States Patent [19]

Ambros et al.

[11] Patent Number: 4,476,048

[45] Date of Patent: Oct. 9, 1984

[54] METHOD OF TREATING RADIOACTIVE WASTE WATER

[75] Inventors: Rainer Ambros, Biblis-Wattenheim; Norbert Brenner, Bürstadt; Jürgen Fischer, Essen; Gottfried Paffrath, Hohen Sülzen; Henrich J. Schroeder, Biblis, all of Fed. Rep. of Germany

[73] Assignee: Rheinisch-Westfälisches Elektrizitätswerk AG, Essen, Fed. Rep. of Germany

[21] Appl. No.: 358,185

[22] Filed: Mar. 15, 1982

[30] Foreign Application Priority Data

Mar. 18, 1981 [DE] Fed. Rep. of Germany ..... 3110491

[51] Int. Cl.[3] ..... G21G 9/08

[52] U.S. Cl. ..... 252/632; 252/628; 252/631; 159/DIG. 12

[58] Field of Search ..... 252/631, 632, 628; 159/DIG. 12

[56] References Cited

U.S. PATENT DOCUMENTS 3,507,801 4/1970 Klausz et al. ..... 252/628

4,253,985 3/1981 Filter et al. ..... 252/631

FOREIGN PATENT DOCUMENTS 106732 6/1974 Fed. Rep. of Germany .
117138 12/1975 Fed. Rep. of Germany .
2447471 4/1976 Fed. Rep. of Germany .
2911272 10/1980 Fed. Rep. of Germany .
49-104100 10/1974 Japan .
53-147200 12/1978 Japan .

OTHER PUBLICATIONS

Ullmanns Encyklopädie der Technischen Chemie (Encyclopedia of Technical Chemistry), 4th Edition, 1974, vol. 8, pp. 666–669.

*Primary Examiner*—Deborah L. Kyle
*Attorney, Agent, or Firm*—Karl F. Ross; Herbert Dubno

[57] ABSTRACT

Radioactive waste water containing boric acid is concentrated in an evaporator to which an alkali is added to maintain a substantially neutral pH. The boric acid is sedimented out by cooling the solution and an acid is added to the latter to increase the solids recovery by lowering the pH. The solid sediment is vacuum distilled to yield a moist powder.

14 Claims, 1 Drawing Figure

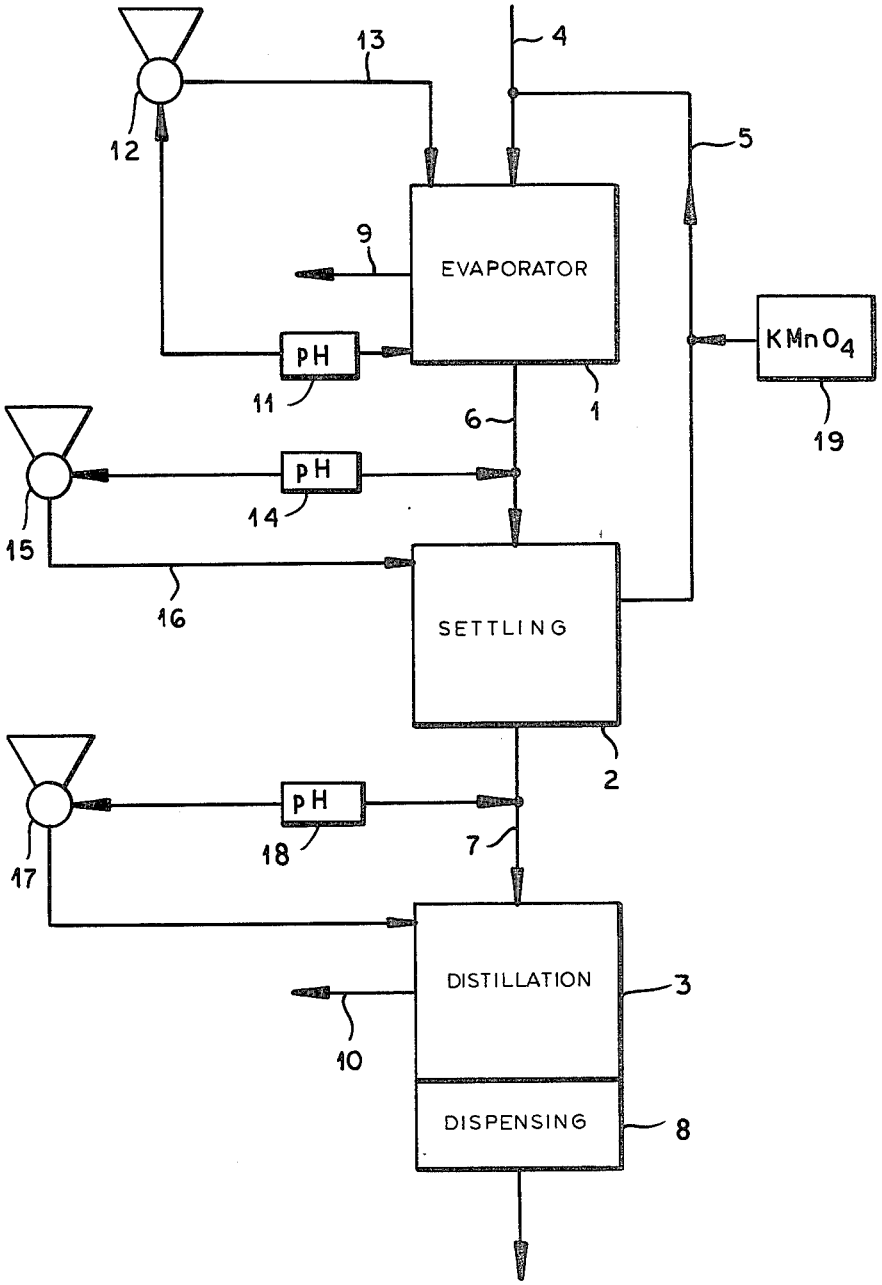
13
4
12
5
9
EVAPORATOR
pH
KMnO4
11
1
6
19
pH
14
15
16
SETTLING
2
pH
18
7
17
DISTILLATION
3
10
DISPENSING
8

METHOD OF TREATING RADIOACTIVE WASTE WATER

CROSS REFERENCE TO RELATED APPLICATIONS

The present invention relates to the commonly assigned patent application Ser. No. 132,084 filed Mar. 20, 1980 and corresponding to German patent document No. 29 11 272.

FIELD OF THE INVENTION

Our present invention relates to a method of treating radioactive waste water and, more particularly, boric-acid-containing waste water produced by nuclear power plants. The invention is especially directed to improvements in the concentration of solids from such waste waters.

BACKGROUND OF THE INVENTION

As has been observed in the aforementioned copending application, nuclear electricity-generating plants from time to time must dispose of radioactive waste water which contains dissolved solids and particularly boric acid. It is known, as described in that application, to reduce the quantity of radioactive material which must be stored, by concentrating the waste water, i.e. evaporating $H_2O$ therefrom and thereby increasing the boric acid concentration to a level which is greater than that before the concentration step so undertaken and greater than the saturation concentration at room temperature, the liquid then being cooled to precipitate out the boric acid. The precipitated solids can be separated from the supernatant liquid by decantation and the liquid can be recycled to the evaporator in which the concentration step is effected.

The evaporation is thereby carried out to a boric acid concentration which is less than the storage concentration at the evaporation temperature, but more than the storage concentration at room temperature, thereby ensuring a significant degree of solids precipitation and sedimentation on cooling to room temperature.

The apparatus for carrying out this process thus comprises an evaporator whose input side receives the waste water fed from the nuclear reactor or recycled waste water from the decantation step, and a storage vessel connected to the output of the evaporator and in which the cooling can be carried out to sediment out the solids, namely the boric acid. The outlet of this storage vessel communicates with the inlet to the evaporator for recycling the decantate and a solids or slurry outlet can be provided at the bottom of this vessel so that the solids can be discharged.

The waste water which is used in the earlier system and for which the present method has been found to be particularly effective, can contain up to about 4,000 parts per million of boron, which is equivalent to 2.5 weight percent of boric acid as solids.

In this earlier system, the solids were generally embedded in a matrix of concrete, bitumen or synthetic resin directly upon withdrawal from the storage vessel or after storage.

Because of the large quantities of the sedimented material which must be stored in many cases, the storage capacity of the plant may be readily exhausted. This, of course, poses a major problem.

OBJECTS OF THE INVENTION

It is the principal object of the present invention to provide an improved method of treating boric-acid-containing radioactive waste water whereby disadvantages of earlier techniques are avoided.

Another object of this invention is to provide an improved method of treating such waste water whereby the storage volume which must be avilable for the boric acid solids can be substantially reduced and the economics of the process improved significantly by comparison with earlier systems. Yet another object of this invention is to provide an improved method of concentrating boric acid waste water from nuclear power plants so that the solids are obtained in a condition which allows compact storage and practically any desired subsequent conditioning including the packaging or treatments described in the aforementioned copending application.

SUMMARY OF THE INVENTION

These objects are attained, in accordance with the invention, in a method of concentrating the solids of a boric-acid-containing waste water of a nuclear power plant wherein the water is evaporated to form a solution which is more concentrated in the boric acid solids and especially has a concentration of boric acid which is less than the saturation concentration at the evaporation temperature but more than the saturation concentration at room temperature, the solution is cooled to precipitate out the boric acid which is sedimented from the solution and the supernatant liquid is separated from the sediment sludge as described, for example, in the above-identified copending application.

According to this invention, however, the pH of the solution during concentration is held at approximately a neutral value and, after separation of the supernatant from the sediment sludge solution, the latter is transformed into a damp powder by vacuum distillation after the pH has been dropped by the addition of an acidic substance to precipitate out additional boric acid.

We have found that, by maintaining the pH substantially at neutral during evaporation and thereafter decreasing the pH, we can markedly increase the quantity of boric acid which can be driven out of the supernatant liquid. The sediment which results, in addition, can be surprisingly effectively reduced in bulk by the vacuum distillation setup which leaves a moist powder. In this case, the apparatus described in the aforementioned copending application can be modified to connect the solution outlet of the sediment with a vacuum distillation unit and to provide means for adding an acid lowering the pH to the sedimentation vessel. Preferably, this acid is oxalic acid.

The pH which might tend to be acid originally can be brought to the neutral level and maintained at neutral during evaporation by the addition of an alkali such as sodium hydroxide.

An important advantage of this invention is that the concentration of the boric acid in the solution before sedimentation is initiated can be increased about twofold or more without danger that precipitation will occur in the evaporator and, moreover, the quantity of boric acid which is driven out of the solution can be increased and the precipitate or sediment sludge recovered in a form which allows it to be transformed into the moist powder by vacuum distillation.

The moist powder can be stored in drums and subjected to any kind of conditioning or packaging, including the storage techniques described in the aforementioned copending application with even greater advantage because, for example, the moist powder is more firmly bound in concrete and like binders. The moist powder which is obtained has a significantly smaller volume than the product previously obtained starting from the same waste water, thereby conserving considerable space in the plant.

BRIEF DESCRIPTION OF THE DRAWING

The above and other objects, features and advantages of the present invention will become more readily apparent from the following description, reference being made to the accompanying drawing, the sole FIGURE in which is a flow diagram illustrating an apparatus for carrying out the method of the present invention.

SPECIFIC DESCRIPTION AND EXAMPLE

While the apparatus shown in the drawing has been represented in diagrammatic form, it will be apparent that the evaporator and settling vessel of this apparatus can be identical to the units described in the aforementioned copending application.

The apparatus comprises an evaporator 1 and a storage vessel 2 which also form a settling tank. A vacuum distillation unit is connected to the vessel 2.

Boric acid containing waste water from a nuclear power plant is fed as represented by line 4 into the evaporator 1 from which $H_2O$ vapor is discharged at 9, thereby concentrating the solution. A pH detector 11 monitors the pH of the solution in the evaporator 1 and controls a dispenser 12 which feeds a base, e.g. sodium hydroxide, via line 13 to the evaporator so that the pH is maintained approximately neutral.

The concentrate is delivered via line 6 to the vessel 2 and its pH is detected at 14, the pH sensor 14 controlling a dispenser 15 which feeds an acid into the vessel 2 to decrease the pH. The acid which is fed by a line 16 to the vessel 2 is preferably oxalic acid.

As the solution cools, the boric acid precipitates and the supernatant liquid is removed as shown by line 5 and recycled to the evaporator. Line 5 communicates with vessel 2 at the upper half thereof.

The sediment sludge is delivered via line 7 to the vacuum distiller 3 which can also be provided with a powder dispenser equivalent to the unit 15 for delivering a pulverulent acid to the vacuum distiller if any supernatant is carried over and before it is decanted.

This dispenser has been represented at 17 and is controlled in response to the pH detected by the unit 18.

A radioactive waste water having a boric acid content up to 2.4% by weight is concentrated in evaporator 1 while the pH value is maintained between 6.8 and 7.2, preferably 7.0 by the addition of sodium hydroxide. The sodium hydroxide can be added directly to the line 4.

In the evaporator 1 the water is concentrated above the storage concentration at room temperature but below the saturation level at the evaporating temperature.

Supply of sodium hydroxide or a solution thereof is maintained as long as evaporation is carried out to maintain this pH level.

Concentrations of 40,000 to 90,000 parts per million of boron, corresponding to 24 to 54% by weight, can be achieved without visible precipitation.

The concentrate is then introduced into the vessel 2 in which it is cooled and the boric acid precipitated. The supernatant liquid can be recycled as described. While recycling of the supernatant is carried out, the acid is not added or the supernatant is treated as described below. Generally, however, the supernatant in vessel 2 is treated with acid to drop the pH.

If, for example, the oxalic acid is added to the vessel 2 and is entrained in the recycled decantate, it is decomposed with permanganate added at 19, i.e. before the decantate enters the evaporator.

The sediment sludge from the vessel 2, consisting of 50 to 70% by weight boric acid, is heated in the vessel 2 to a temperature of 50° to 60° C. and is then introduced into the vacuum distillation unit 3 in which it is converted to a moist powder which is fed by a powder metering device 8 into drums.

We claim:

1. A method of treating radioactive waste water containing boric acid, comprising steps of:

(a) evaporating said waste water to a boric acid concentration above the saturation level at room temperature but below the saturation level at the evaporation temperature to form a concentrate solution of boric acid;

(b) maintaining the pH of said solution during the evaporation in step (a) at substantially neutral;

(c) cooling the solution after evaporation in step (a) to precipitate boric acid from said solution and form a sediment sludge of boric acid;

(d) separating said sludge from a liquid phase in which the pH is reduced to increase the precipitation and settling of boric acid therefrom; and (e) vacuum distilling water from said sediment sludge to transform the same into a moist powder.

2. The method defined in claim 1 wherein the pH during evaporation is held between 6.8 and 7.2.

3. The method defined in claim 2 wherein the pH during evaporation is maintained by the addition of sodium hydroxide.

4. The method defined in claim 1 wherein the evaporation and the sedimentation of boric acid from said solution are carried out in spaced apart locations and said solution is transferred at a temperature above room temperature from the evaporation location to the sedimenting location.

5. The method defined in claim 1 wherein precipitation of boric acid from said solution is carried out by successively lowering the temperature of the solution and adding an acid thereto to reduce the pH.

6. The method defined in claim 5 wherein the two precipitations of boric acid from said solution are carried out separately with respective decantations of supernatant liquid.

7. The method defined in claim 5 wherein said acid is oxalic acid.

8. The method defined in claim 7 wherein supernatant liquid containing oxalic acid is recycled to the evaporation step (a), further comprising treating the recycled supernatant with potassium permanganate.

9. The method defined in claim 1 wherein the boric acid sedimentation and the vacuum distillation are carried out at spaced apart locations and the sludge is heated and is in a flowable state for transfer to the location at which vacuum distillation is carried out.

10. The method defined in claim 9 wherein the solution is heated to a temperature of 50° to 60°.

11. An apparatus for carrying out the method of claim 1 comprising an evaporator for concentrating boric acid in radioactive waste water, a sedimenting vessel connected to said evaporator for precipitating boric acid from a concentrate sludge formed in said evaporator, thereby sedimenting a boric acid sludge in said vessel, and a vacuum distiller connected to said vessel for receiving said sludge therefrom to transform said sludge into a moist powder.

12. The apparatus defined in claim 11 wherein said vacuum distiller is provided with a powder dispenser for filling said powder into a container therefor.

13. The apparatus defined in claim 11, further comprising means for dispensing an acidic suspension into said vessel for reducing the pH of the solution thereof.

14. The apparatus of claim 13, further comprising means for dispensing an alkaline substance into said apparatus for maintaining a substantially neutral pH therein.

* * * * *